United States Patent [19]

Lock

[11] 4,381,964

[45] May 3, 1983

[54] METHOD AND APPARATUS FOR SEPARATING A STAMPER FROM A MOLD

[75] Inventor: Brian E. Lock, Oakland, N.J.

[73] Assignee: RCA Corporation, New York, N.Y.

[21] Appl. No.: 268,285

[22] Filed: May 29, 1981

[51] Int. Cl.[3] ..... C25D 1/20; C25C 7/08

[52] U.S. Cl. ..... 156/344; 204/5; 204/281; 264/334; 264/335; 425/437; 425/440

[58] Field of Search ..... 264/101, 106, 107, 334, 264/335, 313; 425/810, DIG. 44, DIG. 60, 437, 440; 204/3-5, 281; 156/344

[56] References Cited

U.S. PATENT DOCUMENTS

| | | | |
|---|---|---|---|
| 1,036,416 | 8/1912 | Aylsworth | 264/335 |
| 2,642,621 | 6/1953 | Amo | 264/106 |
| 3,414,502 | 12/1968 | Porrata et al. | 204/281 |
| 3,617,450 | 11/1971 | Kawaguchi et al. | 204/281 |
| 3,689,396 | 9/1972 | Casagrande et al. | 204/281 |
| 3,883,403 | 5/1975 | Ettel et al. | 204/281 |
| 3,953,312 | 4/1976 | Kikkawa et al. | 204/281 |
| 3,996,127 | 12/1976 | Rautimo et al. | 204/281 |
| 4,063,863 | 12/1977 | Hilmoe | 425/DIG. 60 |
| 4,157,931 | 6/1979 | Bricot et al. | 264/106 |
| 4,264,405 | 4/1981 | Petrov et al. | 204/281 |
| 4,301,099 | 11/1981 | Broeksema et al. | 425/810 |
| 4,340,353 | 7/1982 | Mayer | 264/106 |
| 4,341,613 | 7/1982 | Prusak et al. | 204/5 |

FOREIGN PATENT DOCUMENTS

| | | | |
|---|---|---|---|
| 1417259 | 12/1975 | United Kingdom | 204/281 |
| 361220 | 1/1973 | U.S.S.R. | 204/281 |

*Primary Examiner*—Willard E. Hoag

*Attorney, Agent, or Firm*—Birgit E. Morris; Donald S. Cohen

[57] ABSTRACT

An apparatus and method for separating a metal stamper from a metal mold on which the stamper is electro-formed. The gas flows between the mold and stamper to separate the stamper from the mold which are maintained separated by the vacuum applied to their back surfaces. Means is provided for centering the mold-stamper assembly between the backing plates just before the assembly is clamped between the backing plates. Means is provided for mechanically bending the outer peripheral portion of the mold-stamper assembly back and forth to separate the peripheral portion of the stamper from the mold.

22 Claims, 6 Drawing Figures

METHOD AND APPARATUS FOR SEPARATING A STAMPER FROM A MOLD

BACKGROUND OF THE INVENTION

The present invention relates to a method and apparatus for use in making stampers used for molding recorded discs. More particularly, the present invention relates to a method and apparatus for separating the stamper from its mold on which it is formed.

Recorded discs are generally formed in a molding apparatus which includes a pair of opposed platens having opposed surfaces which are adapted to form therebetween a mold cavity. At least one of the platens is adapted to move toward and away from the other platen to open and close the mold cavity. On the opposed surface of each mold plate is a separate stamper. Each stamper is a thin sheet of metal, about 0.008 in. (0.2 mm) in thickness, having a surface relief pattern on one surface which is the negative of the information to be formed on the recorded disc. The stampers generally have an opening in the center thereof and are secured to their respective mold plates by a clamping ring around the outer edge of the stamper and a center hold down plate extending through the opening through the stamper and engaging the edge of the center opening in the stamper.

The stampers are generally made by coating a mold, such as by electroplating, with the metal of the stamper until a sheet of the desired thickness is formed. The mold is also a thin metal plate, about 0.019 in. (0.475 mm) in thickness, having on a surface thereof the positive of the surface relief pattern to be formed on the recorded disc. The stamper is electroformed on that one surface of the mold so that the surface relief pattern is formed on the stamper. After the stamper is electroformed on the mold, it must be separated therefrom. Great care must be used to separate the stamper from the mold so as not to damage the surface relief pattern on the surface of either the stamper or the mold. This separation problem is even greater in making stampers for high density recorded discs, such as video discs, because of the high density and fine dimensions of the surface relief pattern on the surface of the stamper. Therefore, it would be desirable to have a method and apparatus which can easily separate the stamper from its mold without damaging either.

SUMMARY OF THE INVENTION

A metal stamper is separated from a mold having an opening through the center thereof by applying a gas under pressure between the stamper and the mold from the edge of the stamper adjacent the opening in the mold and applying forces to the outer surfaces of the stamper and mold in opposite directions to hold them apart after being separated by the pressure applied therebetween. A suitable apparatus includes means for feeding a gas under pressure between the stamper and mold at the center opening of the mold and means for applying forces to the outer surfaces of the stamper and mold to hold them apart after separated by the gas pressure.

DETAILED DESCRIPTION

Figure 1:
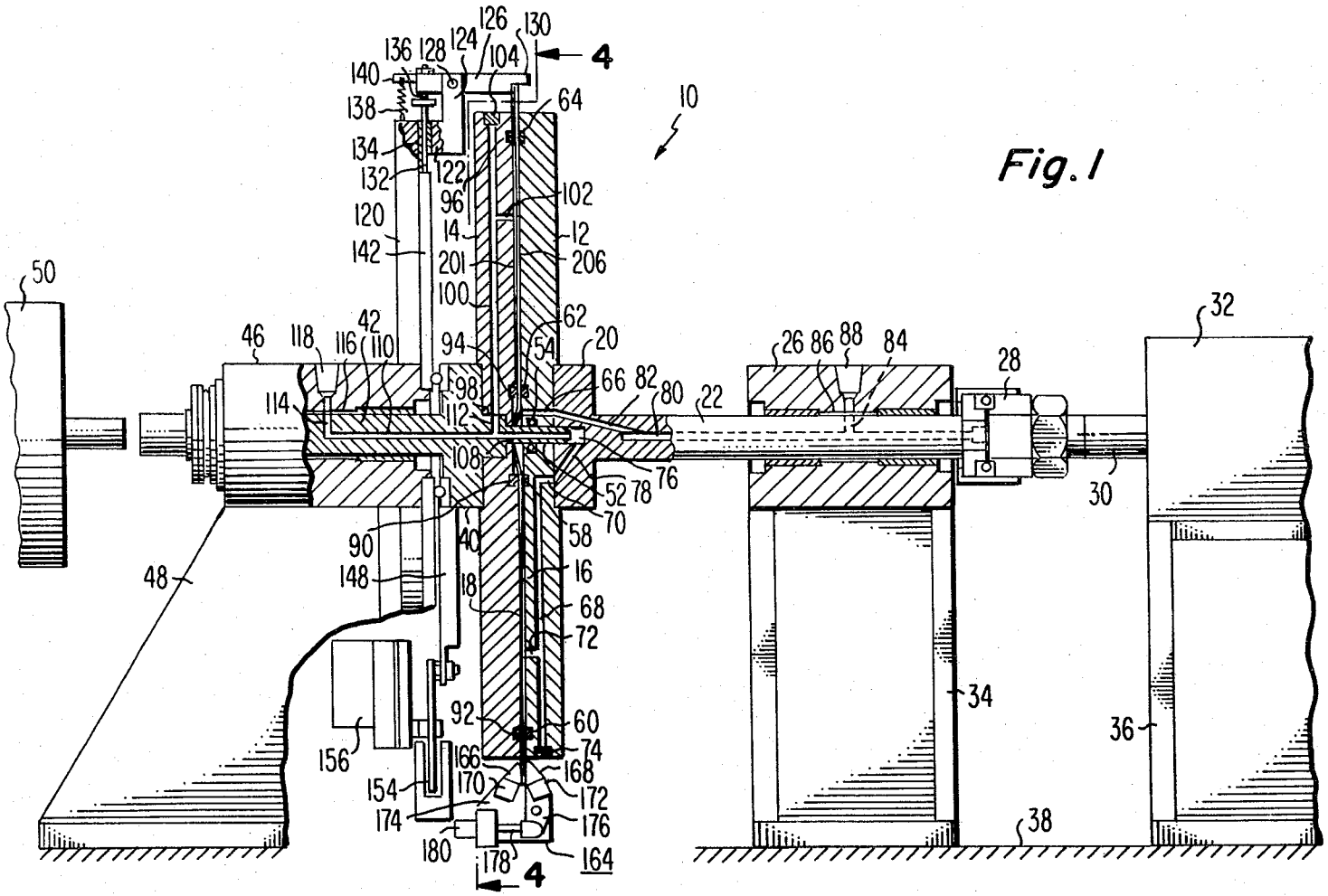
FIG. 1 is a side view, partially in section, of an apparatus incorporating the present invention.

Referring initially to FIG. 1, an apparatus for separating a stamper from its mold which incorporates the present invention is generally designated as 10. The apparatus 10 includes a pair of circular backing plates 12 and 14 having substantially flat surfaces 16 and 18 respectively in opposed relation. The backing plates 12 and 14 are of a diameter less than the diameter of the stamper and mold being separated. The backing plate 12 is mounted on a flange 20 on the end of a shaft 22 by bolts. The shaft 22 is supported in a bearing 26 so as to permit both longitudinal and rotational movement of the shaft 22. The shaft 22 is connected by a universal coupling 28 to the end of a piston rod 30 extending from an air cylinder 32. The bearing 26 and air cylinder 32 are mounted on separate supports 34 and 36 respectively which are seated on a common base 38. The backing plate 14 is mounted on a flange 40 on a shaft 42 by bolts. The shaft 42 is rotatably supported in a bearing 46. The bearing 46 is mounted on a support 48 which is seated on the base 38. The shaft 42 is connected by a gear box 50 to a suitable motor (not shown) for rotating the shaft 42.

Figure 2:
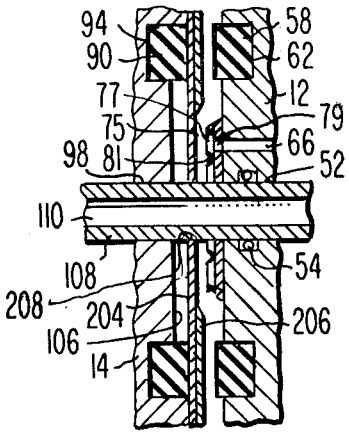
FIG. 2 is a sectional view of the center portion of the backing plates as they are coming together.
Figure 3:
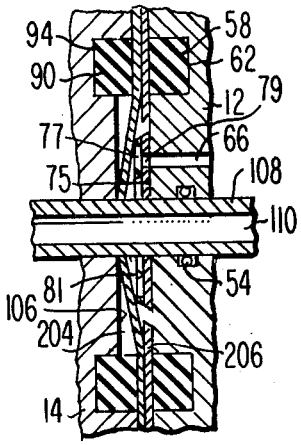
FIG. 3 is a view similar to FIG. 2 with the backing plates completely together.

The backing plate 12 has an opening 52 through the center thereof and an O-ring 54 is in an annular groove in the surface of the opening 52. A pair of annular sealing rings 58 and 60 are mounted in annular grooves 62 and 64, respectively, in the flat surface 16 of the backing plate 12. The sealing ring 58 is positioned adjacent to the central opening 52 and the sealing ring 60 is positioned adjacent the outer periphery of the backing plate 12. A passage 66 extends through the backing plate 12 from the flat surface 16 at a position between the sealing ring 58 and the central opening 52. A passage 68 extends radially through the backing plate 12 from its outer periphery to a point spaced from the central opening 52 and is connected to a passage 70 extending to the flange 20. The passage 68 is connected to the flat surface 16 by a passage 72 located between the sealing rings 58 and 60. The end of the passage 68 at the outer periphery of the backing plate 12 is sealed by a plug 74. As shown in FIGS. 2 and 3, an annular washer 75 is secured to the flat surface 16 of the backing plate 12 around the central opening 52. The washer 75 has a pointed projection 77 extending from its surface around the outer edge thereof and a hole 79 therethrough in alignment with the passage 66. The pointed projection 77 has a plurality of spaced notches 81 therein to allow fluid passing from the passage 66 to flow radially outwardly beyond the washer 75.

The shaft 22 has a blind opening 76 in its end on which the backing plate 12 is mounted which opening 76 is in alignment with the central opening 52 in the backing plate 12. A passage 78 extends through the flange 20 from the opening 76 to the passage 70 in the backing plate 12. The shaft 22 has a passage 80 extending longitudinally along its axis from a point adjacent but spaced from the blind opening 76 across the portion of the shaft 22 which is supported in the bearing 26. A connecting passage 82 extends from the passage 80 to the passage 66 in the backing plate 12. A radially extending passage 84 extends from the passage 88 to the surface of the shaft 22 at a point within the bearing 26. The passage 84 opens into a chamber 86 within the bearing 26 which surrounds the shaft 22 and an inlet port 88 extends through the bearing 26 to the chamber 86.

The backing plate 14 has a pair of annular sealing rings 90 and 92 seated in annular grooves 94 and 96, respectively, in the flat surface 18 of the backing plate. The sealing rings 90 and 92 are positioned to be in direct opposite relation to the sealing rings 58 and 60 respectively in the flat surfaces 16 of the backing plate 12. The backing plate 14 has a central opening 98 therethrough and a passage 100 extends radially through the backing plate 14 from its outer periphery to the opening 98. A passage 102 extends from the passage 100 to the flat surface 18 of the backing plate 14 and is positioned between the sealing rings 90 and 92. The outer end of the radial passage 100 is sealed by a plug 104. The flat surface 18 of the backing plate 14 is provided with an annular recess 106 (see FIGS. 2 and 3) around the central opening 98 and radially within the sealing ring 90.

The shaft 42 has a nozzle 108 projecting longitudinally from its end having the flange 40. The nozzle 108 extends through and beyond the central opening 98 in the backing plate 14. The projecting end of the nozzle 108 is of a diameter equal to the diameter of the central opening 52 in the backing plate 12 and is of a length longer than the thickness of the backing plate 12. The shaft 42 has a passage 110 extending longitudinally therethrough along its axis from the end of the nozzle 108 to a position within the bearing 46. A radially extending passage 112 extends through the shaft 42 from the passage 110 to the inner end of the radial passage 100 in the backing plate 14. A second radial passage 114 extends through the shaft 42 from the inner end of the passage 110 to an annular chamber 116 in the bearing 46 which surrounds the shaft 42. A port 118 extends through the bearing 46 to the chamber 116.

Figure 4:
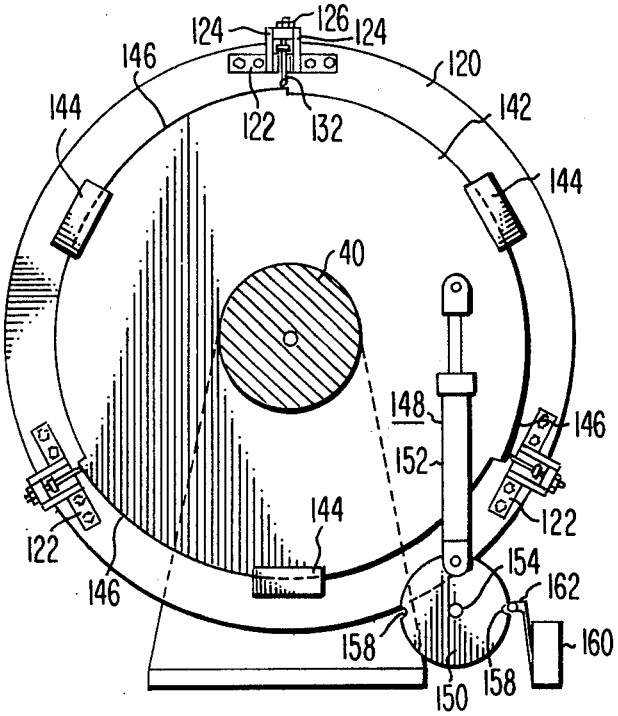
FIG. 4 is a view taken along line 4—4 of FIG. 1.

A circular plate 120 extends around and is secured to the bearing 46 adjacent the backing plate 114. As shown in FIG. 4, three brackets 122 are mounted on the surface of the plate 120 facing the backing plate 14 and are uniformly spaced around the plate 120. Each of the brackets 122 has a pair of spaced, parallel arms 124 projecting radially outwardly beyond the outer edge of the backing plate 14. A separate centering arm 126 is pivotally mounted between each pair of bracket arms 124 by a pivot pin 128. The pivot pin 128 extends through the centering arm 126 between the ends thereof so that portions of the centering arm extend beyond both sides of the bracket arms 124. The centering arm 126 is of a length that when it is in a horizontal position it extends to the flat surface 16 of the backing plate 14, and has a centering finger 130 projecting beyond the flat surface 18 of the backing plate 14 (see FIG. 1). A headed follower pin 132 extends through and is slidable in a hole 134 in each bracket 122 adjacent the surface of the plate 120 on which the bracket 122 is mounted. A screw 136 is threaded through the centering arm 126 over the follower pin 132. A spring 138 is connected between the periphery of the plate 120 and a finger 140 projecting from the centering arm 126, and holds the end of the screw 136 against the end of the follower pin 132.

A circular cam plate 142 is mounted on the surface of the plate 120 which faces the backing plate 14. The cam plate 142 is rotatably mounted on the plate 120 by three bearing brackets 144 which are secured to the plate 120 adjacent the periphery of the cam plate 142 and extend radially inwardly across the surface of the cam plate 142. The periphery of the cam plate 142 has three camming surfaces 146 each of which is engaged by a separate one of the follower pins 132. Each of the camming surfaces 146 has a high point (point of largest radius) at one end and a low point (point of smallest radius) at its other end. An actuating arm 148 is pivotally connected at one end to the cam plate 142 adjacent the periphery of the cam plate. The actuating arm 148 extends substantially vertically downwardly with its other end being pivotally connected to a wheel 150 adjacent the periphery of the wheel 150. The connecting arm 148 includes therein a spring connecting device 152 which allows some expansion or contraction of the length of the actuating arm 148 when excess force is applied thereto. The wheel 150 is mounted on a shaft 154 which is connected to an electric motor 156 (see FIG. 1). The wheel 150 has a pair of notches 158 in its outer periphery. The notches 158 are diametrically opposed to each other and are spaced 90 degrees from the end of the actuating arm 148. A microswitch 160 is mounted adjacent the wheel 150 and has a switch arm 162 which rides on the periphery of the wheel 50 and is adapted to drop into each of the notches 158 when the notches are aligned with the end of the switch arm. The microswitch 160 is electrically connected in the circuit to the electric motor 156.

Mounted adjacent the periphery of the backing plate 14 is an edge bending mechanism 164 (see FIG. 1). The edge bending mechanism 164 includes a pair of conical tips 166 and 168 mounted in bearing housings 170 and 172 respectively for rotation about their longitudinal axes. The bearing housing 170 is mounted on a plate 174. The bearing housing 172 is mounted on one end of an arm 176 which is pivotally mounted between its ends on the plate 174 so that the tip 168 can be moved toward and away from the tip 166. The other end of the arm 176 is pivotally connected to the piston rod 178 of an air cylinder 180 which is mounted on the plate 174. The air cylinder 180 serves to pivot the plate 176 to move the tip 168 toward or away from the tip 166.

Figure 6:
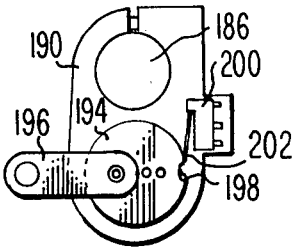
FIG. 6 is a view taken along line 6—6 of FIG. 5.
Figure 5:
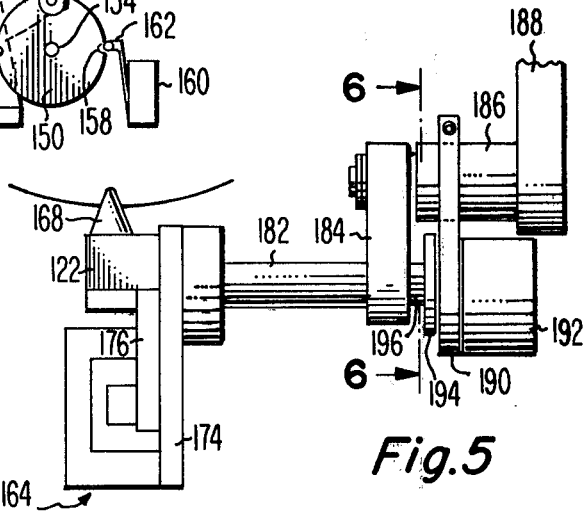
FIG. 5 is an elevational view of the edge bending mechanism of the apparatus.

A shaft 182 is secured at one end to the side of the plate 174 opposite to the side on which the tip 166 is mounted (see FIG. 5). The other end of the shaft 182 is secured to one end of an arm 184 which is rotably supported at its other end on the end of a post 186 extending from a support plate 188. A bracket 190 is fixedly mounted on the post 186 and extends below the post. An electric motor 192 is supported on the bracket 190 and has a wheel 194 on the end of its output shaft. A linkage arm 196 is connected between the wheel 194 and the end of the arm 184 to which the shaft 182 is connected (see FIG. 6). The wheel 194 has a notch 198 in its outer periphery at a point diammetrically aligned with but spaced from the point that the linkage arm 196 is connected to the wheel 194. A microswitch 200 is mounted on the bracket 190 adjacent to wheel 194 and has a switch arm 202, the end of which rides on the periphery of the wheel 194.

In the operation of the apparatus 10, a mold 204 having a stamper 206 thereon (hereinafter referred to as the "mold-stamper assembly") is placed between the separated flat surfaces 16 and 18 of the backing plates 12 and 14 with the nozzle 108 extending through a hole 208 in the center of the mold 204. In plating the stamper 206 on the mold 204, the inner edge of the stamper 206 tapers in thickness to a feathered edge. Also, as shown in FIGS. 2 and 3, the inner edge of the stamper 206 is spaced from the edge of the hole 208 in the mold 204. Mold-stamper assembly is placed between the backing plates 12 and 14 with the mold 204 being against the flat surface 18 of the plate 14 and the stamper 206 facing the flat surface 16 of the backing plate 12.

The air cylinder 32 is actuated to move the backing plate 12 toward the backing plate 14 so as to clamp the mold-stamper assembly between the backing plates. When the backing plate 12 is very close to the backing plate 14 but not tight against the stamper 206, the cam plate 142 is rotated to bring the high point of each camming surface 146 under its respective follower pin 132 so that the follower pin 132 is moved radially outwardly. This pivots the centering arms 126 to bring the aligning fingers 130 over the outer edge of the mold-stamper assembly and thus center the mold-stamper assembly between the backing plates 12 and 14 as shown in FIG. 1. When the backing plate 12 is tight against the stamper 206 so that the centered mold-stamper assembly is clamped tightly between the backing plates 12 and 14, the cam plate 142 can then be rotated to bring the low point of each camming surface 146 under the follower pins 132. This allows the spring 138 to pivot the centering arms 126 and move the centering fingers 130 away from the outer edge of the mold-stamper assembly.

The rotation of the camming plate 142 is carried out by operating the electric motor 156 which causes the wheel 150 to rotate. Through each 180 degrees of rotation of the wheel 150 the actuating arm 148 is moved either vertically upwardly or downwardly. When the actuating arm 148 is moved vertically downwardly, the camming plate 142 is rotated to bring the low points of the camming surface 146 under the follower pins 132 and when the actuating arm 148 is moved vertically upwardly the camming plate 142 is rotated in the opposite direction to bring the highest points of the camming surface 146 under the follower pins 132. When the actuating arm 148 reaches either its uppermost or lowermost position, the end of the microswitch arm 162 drops into one of the notches 158 so as to actuate the switch 160 and turn off the electric motor 156.

A vacuum pump (not shown) which is connected to the port 118 in the bearing 46 is turned on to draw a vacuum through the passage 110 in the shaft 42 and radial passages 68 and 100 in the backing plates 12 and 14. This vacuum is applied to the mold 204 and stamper 206 respectively through the passages 102 and 72 in the backing plates. The sealing rings 58 and 60 in the backing plate 12 and the sealing rings 90 and 92 in the backing plate 14 maintain the vacuum along the surfaces of the stamper 206 and mold 204 respectively.

When the mold-stamper assembly is mounted between the backing plates 12 and 14, the conical tips 166 and 168 of the bending mechanism 164 are apart so that the outer edge of the mold-stamper assembly fits between the tips. After the mold-stamper assembly is properly aligned between the backing plates 12 and 14 and held therein, the air cylinder 180 is actuated to pivot the arm 176 so as to bring the tips 166 and 168 together and clamp the peripheral edge of the mold-stamper assembly therebetween. The motor 192 is then operated to rotate the wheel 194 and thus pivot the plate 174 so that the interface between the tips 166 and 168 is turned at an angle to the vertical. This bends the portion of the peripheral edge of the mold-stamper assembly which is between the tips 166 and 168. The motor connected to the shaft 42 is then operated to rotate the shaft which rotates the backing plates 12 and 14 and the mold-stamper assembly. Thus, the entire peripheral edge of the mold-stamper assembly passes between the tips 166 and 168 so as to bend the entire peripheral edge of the mold-stamper assembly. After the mold-stamper assembly is rotated at least one revolution, the electric motor 192 is again operated to pivot the plate 174 and thus bend the portion of the mold-stamper assembly which is between the tips 166 and 168 in the reverse direction. The shaft 42 is again rotated to rotate the mold-stamper assembly and thereby bend the entire periphery of the mold-stamper assembly in the reverse direction. This bending of the periphery of the mold-stamper assembly back and forth causes the periphery of the stamper to separate from the mold. The air cylinder 180 is then actuated to pivot the arm 176 and separate the tips 166 and 168.

A gas, such as hydrogen or clean dry air, under pressure is then admitted through the port 88 in the bearing 26 into the passage 80 in the shaft 22. The gas is applied at a high pressure, for example about 70 psi, but at little or no flow rate. The gas passes through the passage 82 in the shaft 22, the passage 66 in the backing plate 12, the hole 77 in the washer 75, and the notches 81 in the washer 75 to the space between the backing plates 12 and 14 radially within the inner sealing rings 28 and 90. When the backing plate 12 was moved against the backing plate 14, the pointed projection 79 of the washer 75 cuts through the inner edge of the stamper 206, engages the portion of the mold 204 around the hole 208, and bends it into the recess 106 in the flat surface 18 of the backing plate 18, as shown in FIG. 3. This separates the inner peripheral edge of the mold 204 slightly from the inner edge of the stamper 206. The gas under pressure entering the space around the inner edge of the mold 204 and stamper 206 flows radially outwardly between the mold 204 and stamper 206 to cause them to separate. When the flow of the gas passes radially outwardly beyond the sealing rings 28 and 90, the vacuum applied to the surfaces of the mold 204 and stamper 206 applies a force to the mold 204 and stamper 206 which holds them apart. Thus, as the gas under pressure moves radially outwardly the vacuum on the mold 204 and stamper 206 provides a bending effect which causes a continuous separation of the stamper 206 from the mold 204 until the gas reaches the outer peripheral portion of the mold-stamper assembly which were previously separated by the bending effect. The stamper 206 is then completely separated from the mold 204 and each is retained against the flat surface of its respective backing plate by the vacuum applied thereto. The air cylinder 32 is then operated to move the backing plate 12 away from the backing plate 14 and the vacuum is released to allow removal of the separated stamper 206 and mold 204.

Although the separating apparatus 10 is shown with the shafts 22 and 42 extending horizontally, the apparatus 10 can be mounted with the shafts 22 and 42 being vertical and with the backing plate 14 being above the backing plate 12. In the operation of the apparatus 10 in this position, with the backing plate 12 being lowered away from the backing plate 14, a mold-stamper assembly is placed on the flat surface 16 of the backing plate 12 with the stamper 206 facing the flat surface 16. The air cylinder 32 is then activated to move the backing plate 12 toward the backing plate 14. The apparatus then operates in the manner previously described to separate the stamper 206 from the mold 204. The air cylinder 32 is then again activated to move the backing plate 12 away from the backing plate 14. When the backing plate 12 is moved sufficiently so that it is away from the nozzle 108 on the end of the shaft 42, the vacuum to the back of the stamper 206 is broken so that the stamper is only held on the backing plate 12 by gravity. However, the vacuum is still applied to the mold 204 so that it is held to the backing plate 14. When the backing plates 12 and 14 are completely separated, the vacuum can be turned off to permit removal of the mold 204 as well as the stamper 206.

Thus, there is provided an apparatus for automatically separating a stamper from the mold on which the stamper is formed. Since the separation is accomplished by passing a gas between the contacting surfaces of the mold and stamper, the separation is achieved without scratching or otherwise damaging the active portions of the surfaces of the mold or stamper. Thus, there is provided substantially defect free stampers with the molds being in good condition for reuse in forming additional stampers.

I claim:

1. A method of separating a metal stamper from a mold having an opening through the center thereof comprising the steps of:

bending the edge of the mold around said opening therethrough away from the adjacent edge of the stamper to allow gas to pass between the mold and the stamper applying a gas under pressure between the stamper and mold from the edge of the stamper adjacent the opening in the mold, and applying forces to the outer surfaces of the stamper and mold in opposite directions to hold them apart after being separated by the pressure applied therebetween.

2. A method in accordance with claim 1 in which the gas is applied under a relatively high pressure and at little or no flow rate.

3. A method in accordance with claim 1 in which the forces applied to the outer surfaces of the stamper and mold are applied by means of a vacuum.

4. A method in accordance with claim 3 including the step of bending back and forth the outer portion of the stamper and mold to separate the said outer edge portion of the stamper from the mold.

5. Apparatus for separating a metal stamper from a mold having an opening through the center thereof comprising:

means for introducing a gas under pressure between the stamper and the mold from the edge of the stamper adjacent the opening in the mold, and means for applying forces to the outer surfaces of each of the stamper and the mold to hold them apart after being separate by the flow of gas therebetween, and means for bending the edge of the mold around the opening therethrough away from the adjacent edge of the stamper so as to provide a space into which the gas under pressure is introduced.

6. Apparatus in accordance with claim 5 in which the means for applying forces to the outer surfaces of the stamper and mold includes means for applying a vacuum to the outer surfaces of the stamper and mold.

7. Apparatus in accordance with claim 5 including means for bending back and forth the outer peripheral portion of the stamper and mold to cause them to separate.

8. Apparatus for separating a metal stamper from a mold comprising:

a pair of circular backing plates having opposed substantially flat surfaces, and central openings therethrough, means supporting one of said backing plates for rotation about the center of said one backing plate, means supporting the other of said backing plates for rotation about its center and for movement toward and away from the one backing plate, means for applying a vacuum at the opposed surfaces of said backing plates, and means for introducing a gas under pressure to the opposed surfaces of the backing plates adjacent the central openings therethrough.

9. Apparatus in accordance with claim 8 in which the means supporting the one backing plate comprises a first shaft rotatably supported in a bearing and secured at one end to the center of the surface of the one backing plate opposite the flat surface, and the means supporting the other backing plate comprises a second shaft secured at one end to the center of the surface of the other backing plate opposite the flat surface and supported in a bearing for rotation and longitudinal movement along the axis of the second shaft.

10. Apparatus in accordance with claim 9 in which the means for introducing a gas to the opposed surfaces of the backing plates includes a passage extending through the other backing plate from its flat surface to the surface opposite the flat surface and adjacent the end of the second shaft and a passage extending longitudinally through the second shaft from the end thereof and connected to said passage in the other backing plate, the passage in the shaft opening to a port through which the gas is admitted into the passage.

11. Apparatus in accordance with claim 9 including an annular projection extending from the flat surface of the other backing plate around the opening therethrough, and a recess in the flat surface of the one backing plate around the opening therethrough, said projection adapted to fit in the recess when the flat surfaces of the backing plates are brought together.

12. Apparatus in accordance with claim 9 including means adjacent the periphery of the one backing plate for gripping the outer peripheral portion of a mold-stamper assembly and bending said peripheral portion back and forth to separate the stamper from the mold along said peripheral portion.

13. Apparatus in accordance with claim 12 in which the means for gripping and bending the peripheral portion of the mold-stamper assembly includes a pair of fingers pivotally secured together so that they can be moved between a position in which they are separated and a position in which they are together, and means supporting said fingers to permit pivoting the fingers together so as to bend said peripheral portion of the mold-stamper assembly.

14. Apparatus in accordance with claim 9 including means around the other periphery of the one backing plate for centering a stamper-mold assembly on the flat surfaces of the backing plates when the assembly is clamped between the backing plates.

15. Apparatus in accordance with claim 14 in which the means for centering the stamper-mold assembly includes a plurality of centering arms mounted in circumferentially uniformly spaced relation around and spaced from the outer periphery of the one backing plate, each of said arms being pivoted between a first position in which it extends transversely across the outer periphery of the one backing plate so as to engage the outer edge of the stamper-mold assembly and a second position away from the outer periphery of the one backing plate.

16. Apparatus in accordance with claim 15 including camming means for selectively moving the centering arms between the first and second positions.

17. Apparatus in accordance with claim 9 including a pair of annular sealing rings in the flat surfaces of each of said backing plates, one of the sealing rings being adjacent the outer periphery of its respective backing plate and the other sealing ring being adjacent the central opening in its respective backing plate, and the sealing rings in the one backing plate being opposed to the sealing rings in the outer backing plate.

18. Apparatus in accordance with claim 17 in which the means for applying a vacuum includes connecting passages extending through each of said backing plates and each of said shafts, the passages in each of said backing plates opening at the flat surface of the backing plate between the sealing rings, and the passages in said shafts opening to a port to which a vacuum source can be connected.

19. Apparatus in accordance with claim 18 in which the passages in each of the backing plates includes a passage extending radially from the outer periphery of the backing plate and a passage extending from the flat surface of the backing plate to the radially extending passage, and a plug is within and seals the outer end of the radially extending passage.

20. Apparatus in accordance with claim 19 in which the second shaft has a blind hole in its end on which the other backing plate is mounted with the hole being aligned with the opening through the other backing plate, the first shaft has a nozzle on its end on which the one backing plate is mounted, said nozzle extending through the opening in the one backing plate and projecting beyond the flat surface of the one backing plate a distance greater than the thickness of the other backing plate, the projecting portion of the nozzle being of a diameter substantially equal to the diameter of the opening in the other backing plate.

21. Apparatus in accordance with claim 20 in which the passages in said first shaft include a passage extending longitudinally along the axis of the first shaft from the end of the nozzle, a passage extending radially from the longitudinal passage to the opening in the one backing plate and a passage extending radially from the longitudinal passage to said port, and the radially extending passage in the one backing plate extends to the opening in the one backing plate and connects with the radially extending passage in the first shaft.

22. Apparatus in accordance with claim 21 in which the passages in the second shaft extend from the blind hole to the other backing plate and the other backing plate has a passage therethrough connected between its radially extending passage and the passage in the second shaft.

* * * * *